US010847327B2

(12) United States Patent
Perrin

(10) Patent No.: US 10,847,327 B2
(45) Date of Patent: Nov. 24, 2020

(54) ELECTRICAL SWITCHING DEVICE WITH REMOVABLE RECHARGING MODULE

(71) Applicant: Schneider Electric Industries SAS, Rueil Malmaison (FR)

(72) Inventor: Denis Perrin, St Nicolas de Macherin (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 16/188,748

(22) Filed: Nov. 13, 2018

(65) Prior Publication Data

US 2019/0189366 A1 Jun. 20, 2019

(30) Foreign Application Priority Data

Dec. 15, 2017 (FR) ..... 17 62203

(51) Int. Cl.
*H01H 3/30* (2006.01)
*H01H 3/38* (2006.01)
(Continued)

(52) U.S. Cl.
CPC ..... *H01H 3/30* (2013.01); *H01H 3/38* (2013.01); *H01H 71/66* (2013.01); *H01H 71/70* (2013.01);
(Continued)

(58) Field of Classification Search
CPC ..... H01H 33/42; H01H 3/46; H01H 3/26; H01H 2205/002; H01H 33/666;
(Continued)

(56) References Cited

U.S. PATENT DOCUMENTS 5,224,590 A 7/1993 Milianowicz et al.
2011/0073453 A1* 3/2011 Bottcher ..... H01H 3/3047 200/400
2013/0134983 A1* 5/2013 Cazals ..... H01H 71/04 324/415

FOREIGN PATENT DOCUMENTS

EP 2 377 139 A1 10/2011
EP 2 597 427 A1 5/2013
WO WO 2010/076403 A1 7/2010

OTHER PUBLICATIONS

French Preliminary Search Report dated Sep. 4, 2018 in French Application 17 62203, filed on Dec. 15, 2017 (with English Translation of Categories of Cited Documents & Written Opinion).

* cited by examiner

*Primary Examiner* — Ahmed M Saeed
(74) *Attorney, Agent, or Firm* — Oblon, McClelland, Maier & Neustadt, L.L.P.

(57) ABSTRACT

The invention relates to an electrical switch device comprising contacts which are mobile through actuation of a first rotation shaft (10) and a control mechanism (1) for the mobile contacts which is situated in a housing and which can be rearmed via a second rotation shaft (20). The first rotation shaft (10) passes through a first wall (2, 3) of the housing and the device comprises a first rotation sensor (12) coupled with the first rotation shaft (10) outside of the housing, so as to measure the angular displacement of the first rotation shaft. The second rotation shaft (20) passes through a second wall (2, 3) of the housing and the device comprises a rearming module (25, 26) removably fixed outside of the housing against the second wall (2, 3), so as to be coupled with the second rotation shaft (20) to be able to rearm the control mechanism.

9 Claims, 2 Drawing Sheets

(51) Int. Cl.
*H01H 71/66* (2006.01)
*H01H 71/70* (2006.01)

(52) U.S. Cl.
CPC ..... *H01H 2003/3089* (2013.01); *H01H 2003/3094* (2013.01)

(58) Field of Classification Search
CPC .... H01H 11/0062; H01H 13/52; H01H 15/24; H01H 2003/323; H01H 2009/0088; H01H 2231/052; H01H 2235/01; H01H 2300/052; H01H 35/2614; H01H 3/227; H01H 3/36; H01H 2003/266; H01H 2003/326; H01H 2071/006; H01H 2221/01; H01H 2300/018; H01H 31/00; H01H 31/10; H01H 71/1009; H01H 9/26; H01H 3/30; H01H 71/66; H01H 3/38; H01H 71/70; H01H 2003/3089; H01H 2003/3094
See application file for complete search history.

ELECTRICAL SWITCHING DEVICE WITH REMOVABLE RECHARGING MODULE

TECHNICAL FIELD OF THE INVENTION

The invention relates to an electrical device and its control mechanism. In the present document, the term electrical device encompasses, equally, several types of switch devices such as a switch, a disconnector, a circuit breaker, a fuse switch, a recloser, etc. The invention is particularly suited to medium voltage and high voltage electrical devices, that is to say devices operating on an electrical supply network with a voltage greater than 1000V.

STATE OF THE ART

As is known, such an electrical device has contacts which are mobile in order to have current circulate or not in the different phases of an electrical network. These contacts are mobile between a closed position in which they are in contact with corresponding fixed contacts and an open position in which they are disconnected from these fixed contacts.

The movements of opening and of closure of the mobile contacts are produced from a control mechanism which is capable of driving the mobile contacts. This control mechanism can be rearmed so as to be always ready to perform a possible imminent closure trip. This rearming is performed using a rearming module which is linked mechanically to the control mechanism to allow it to store enough energy. The rearming generally consists in retensioning springs which will thus be ready to rapidly close the contacts as soon as a closure command occurs.

A rearming module can operate by different technologies according to the applications in which the electrical device is installed (for example, the rearming module can comprise a planetary gear system or a ratchet system) and according to the choices of the client user (for example, choice between manual or motorized control).

To facilitate the production of the switch, it would be advantageous for the choice between these different technologies of the rearming module to be able to be made at the last minute, in the final customization of the electrical device, that is to say on starting the final assembly of the electrical device, upon the integration of its control mechanism.

Furthermore, there are other optional functionalities which are involved in the customization of the electrical device, such as, for example, the possibility of installing auxiliary contacts of the electrical device which make it possible to know whether the mobile contacts of the electrical device are in open position or in closed position. Now, this option is often produced by using sometimes complex and/or bulky mechanical links between the control axes of the mobile contacts of the electrical device and these auxiliary contacts.

There is therefore a need to propose a simple and economical solution that makes it possible to facilitate the customization of the control mechanism for the mobile contacts of an electrical device and to simplify the production of the auxiliary functions.

SUMMARY OF THE INVENTION

This aim is achieved through an electrical switch comprising contacts which are mobile through actuation of a first rotation shaft and comprising a control mechanism for the mobile contacts which is situated in a housing and which can be rearmed via a second rotation shaft. It is characterized in that the first rotation shaft passes through a first wall of the housing and the switch comprises a first rotation sensor which is coupled with the first rotation shaft outside of the housing, so as to measure the angular displacement of the first rotation shaft, and in that the second rotation shaft passes through a second wall of the housing and the switch comprises a rearming module which is removably fixed outside of the housing against the second wall, so as to be coupled with the second rotation shaft to be able to rearm the control mechanism.

According to one feature, the second wall of the housing comprises fixing means capable of fixing a rearming module comprising a planetary gear system, and capable of fixing a rearming module comprising a ratchet system. The planetary gear system can be driven by a crank or by an electric motor. The ratchet system can be driven by a lever or by an electric motor.

According to another feature, the first rotation shaft comprises longitudinal splines, the first rotation sensor comprising complementary splines to be driven by the first rotation shaft. The second rotation shaft comprises longitudinal splines, the rearming module comprising complementary splines to be driven by the second rotation shaft.

According to another feature, the first wall and the second wall correspond to one and the same lateral wall of the housing of the control mechanism. Alternatively, the first wall and the second wall correspond respectively to two opposite lateral walls of the housing of the control mechanism.

According to another feature, the switch comprises a second rotation sensor which is coupled with the second rotation shaft outside of the housing, so as to measure the angle of rotation of the second rotation shaft.

By virtue of the invention, the control mechanism of the electrical device is advantageously of modular design, that is to say that it can easily receive different types of interchangeable rearming modules using different technologies, and optional add-ons. It can thus be customized which in particular optimizes the production thereof.

Furthermore, since these rearming modules are removable, the replacement of one rearming module using a technology with another using another technology is also facilitated, as is the replacement of a defective rearming module. Conversely, one and the same given rearming module can easily be mounted on different types of electrical devices.

DETAILED DESCRIPTION

Other features will emerge from the following detailed description given in light of the attached drawings in which.

An electrical device comprises a control mechanism for opening and closing the mobile contacts of the electrical device. This control mechanism is generally situated on the front face of the electrical device, so as to be able to be controlled by an operator via human-machine dialogue members (knobs, indicators, remote electrical controls, etc.).

The control mechanism comprises complex mechanical parts and must be able to store up a lot of energy, in particular via various springs to perform the opening and closing movements, and in particular be capable of performing sequences of "open-close-open" type which are required in certain standardized conditions. To store up this energy, the control mechanism is coupled with a rearming module, manual or motorized, responsible for rearming the control mechanism.

Figure 1:
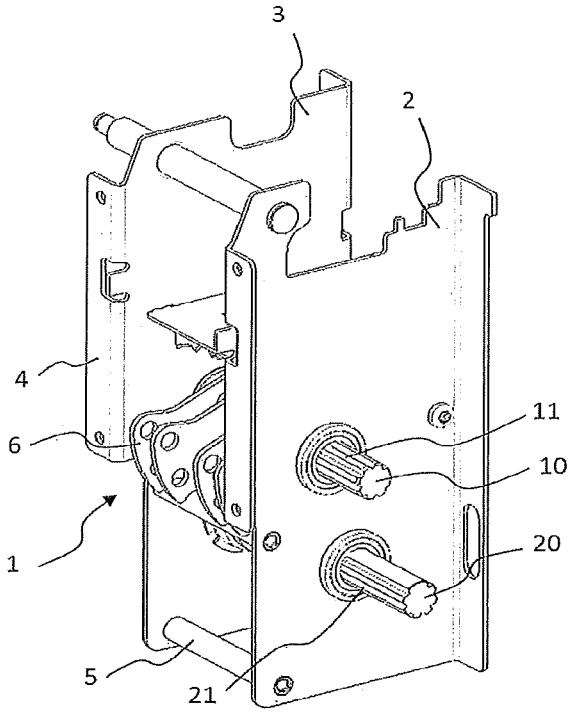
FIG. 1 represents a partial perspective view of a control mechanism of an electrical device according to the invention, without rearming module or rotation sensor.
Figure 2:
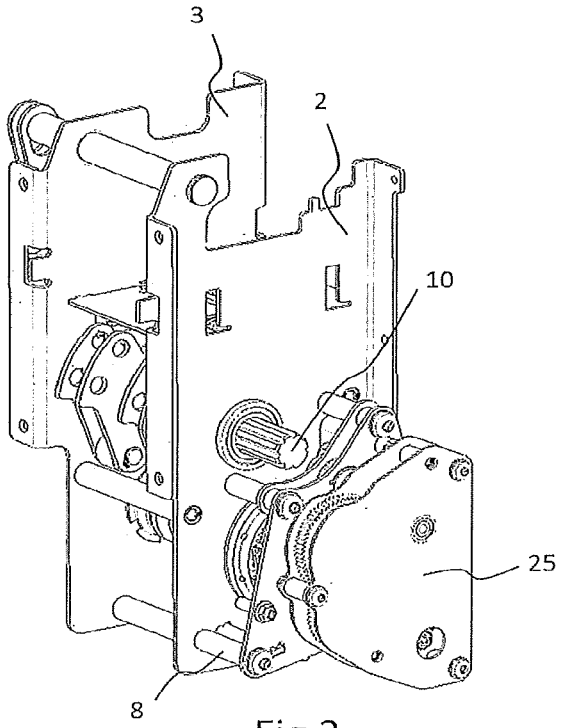
FIGS. 2 and 3 show the control mechanism of FIG. 1 on which are mounted different types of rearming modules.
Figure 3:
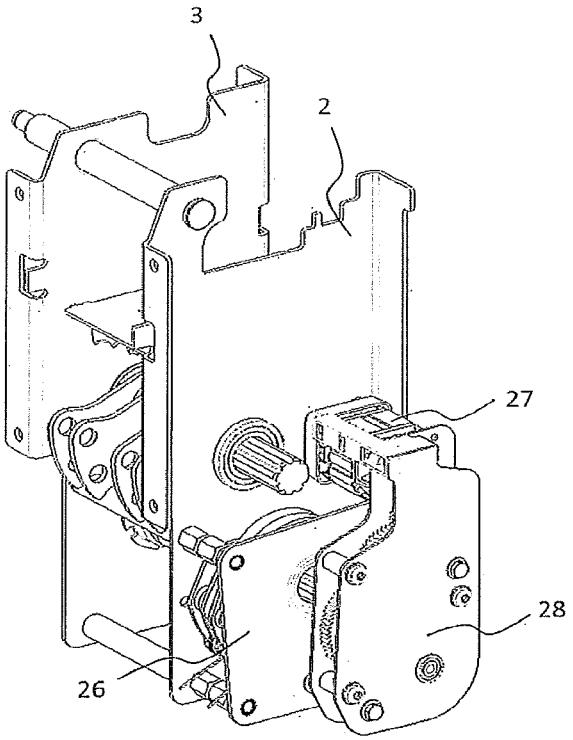

FIGS. 1, 2 and 3 show a control mechanism 1 of an electrical switch device for medium or high voltage electrical network. The control mechanism 1 is housed in a housing whose outlines are embodied by two parallel lateral walls 2 and 3. The housing of the control mechanism 1 is also embodied by a rear face 4 which is intended to be fixed onto the switch (not represented in the figure) and a front face on which will be placed in particular a human-machine interface for controlling the device. The two lateral walls can be linked to one another by several fixing elements 5.

As is known, the control mechanism 1 comprises a first rotation shaft 10 which is coupled mechanically with the mobile contacts of the electrical device so as to be able to open and close these mobile contacts. Only a part 6 of this coupling is shown in FIG. 1. The control mechanism 1 also comprises a second rotation shaft 20 which makes it possible to rearm the springs of the control mechanism 1, in order for the device to store up enough energy.

According to the invention, the second rotation shaft 20 passes through one of the lateral walls 2, 3 of the housing, called second wall, and the device comprises a rearming module 25, 26 which is fixed outside of the housing against the second wall, so as to be coupled with the second rotation shaft 20, as indicated in the figures. Once coupled, the rearming module 25, 26 is capable of rearming the control mechanism. This mechanical coupling can be done simply, for example using longitudinal splines 21 over a part of the second transmission shaft 20 cooperating with complementary splines in the rearming module 25, 26.

In the embodiment of FIG. 2, the rearming module 25 comprises a planetary gear system which can be either motorized and remotely controllable, or actuated manually by rotation of a crank situated on the front face of the device (not represented).

In the embodiment of FIG. 3, another rearming module 26 uses an alternative technology which comprises a ratchet system. In FIG. 3, this ratchet system 26 is driven by a gear motor assembly comprising an electric motor 27 associated with a reducing gear 28. This ratchet system 26 could also be driven by pumping using a manual lever on the front face.

As for the rearming module 25 with planetary gears, the rearming module 26 with ratchet and the gear motor assembly 27, 28 can be fixed removably outside of the housing against the second wall and thus be coupled to the control mechanism 1, for example using a simple arrangement of screw/nut/spacer type 8.

This advantageous modular structure of the electrical device thus makes it possible to choose, at the last minute, the desired rearming module 25, 26, to easily dismantle it and replace it with another, without performing any other modification or intervention on the control mechanism 1, which gives a lot of versatility in the last minute adaptation of the electrical device to the needs of the application or of the client user and in the maintenance of the electrical device.

According to the invention, the first rotation shaft 10, which gives the image of the position of the mobile contacts of the device, also passes through one of the lateral walls 2, 3 of the housing, called first wall.

In the preferred embodiment, the first wall and the second wall correspond to one and the same lateral wall 2 of the housing of the control mechanism 1, that is to say that the rotation shafts 10, 20 exit on the same side and therefore pass through the same lateral wall 2.

Alternatively, it would have been possible to envisage having the first wall and the second wall correspond to the two opposite lateral walls 2, 3 of the housing of the control mechanism, for example the first wall is the wall 2 and the second wall is the wall 3.

Figure 4:
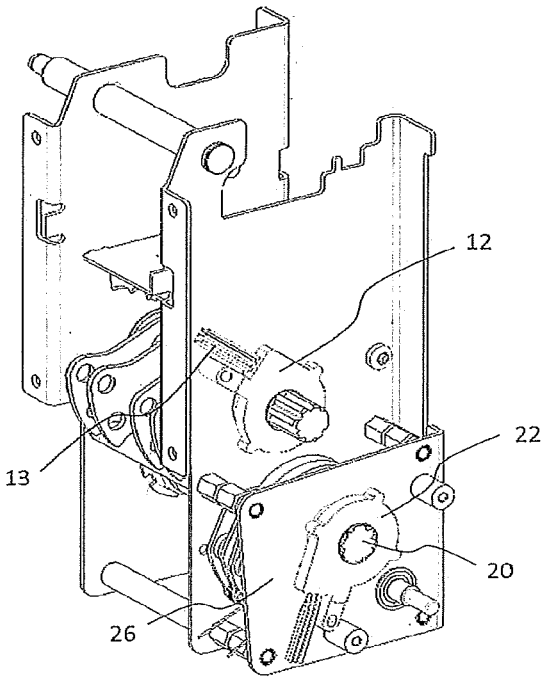
FIG. 4 shows the control mechanism of FIG. 1 on which are mounted rotation sensors.

FIG. 4 reprises the control mechanism 1 of FIG. 1 and adds a first rotation sensor 12 which is coupled with the first rotation shaft 10 outside of the housing, for example using longitudinal splines 11 on the shaft 10 which cooperate with complementary splines in the first rotation sensor 12. The first rotation sensor 12 can be fixed directly against the first wall 2, but it would also be possible to envisage having it slightly offset relative to the first wall 2 while obviously remaining coupled with the first rotation shaft 10.

Thus, the first rotation sensor 12 is capable of measuring the angular displacement of the first rotation shaft 10 and of deducing therefrom information on the state (open or closed) of the mobile contacts of the device. It supplies one or more output signals 13 which can be used in particular for supervisory purposes or for information on the state of the mobile contacts of the device and also to electrically control auxiliary contacts of the device, which avoids having mechanical links that are sometimes complex or bulky between the first rotation shaft 10 and control members for auxiliary contacts. The first rotation sensor 12 is also capable of giving information on the speed of the closing movement.

FIG. 4 also shows an optional second rotation sensor 22 which is coupled with the second rotation shaft 20 outside of the housing, using the longitudinal splines 21 on the shaft 20 which cooperate with complementary splines in the second rotation sensor 22. This second rotation sensor 22 is for example fixed and placed between the rearming module 26 and the reducing gear 28.

The second rotation sensor 22 thus supplies an output signal representative of the angle of rotation performed by the second rotation shaft 20 so as, in particular, to determine the excess (therefore residual) energy of the control mechanism in a closure movement. Indeed, the variations of the angular displacement of the second shaft 20 give information on the energy reserve available in a closure movement. The variation in time of this energy reserve will advantageously make it possible to detect wear of the parts of the control mechanism, with a view to preventive maintenance. The second rotation sensor 22 could also supply a signal representative of the speed of the movements of the shaft 20.

By virtue of the modular structure provided by the invention, it is therefore very easy to add to a control mechanism according to the invention one or more rotation sensors making it possible to enrich the functionalities of the device.

The invention claimed is:

1. An electrical switch comprising:

contacts which are mobile through actuation of a first rotation shaft; and a control mechanism for the mobile contacts which is situated in a housing and which can be rearmed via a second rotation shaft, wherein:

the first rotation shaft passes through a first wall of the housing and the switch comprises a first rotation sensor which is coupled with the first rotation shaft outside of the housing, so as to measure the angular displacement of the first rotation shaft, and the second rotation shaft passes through a second wall of the housing and the switch comprises a rearming module which is removably fixed outside of the housing against the second wall, so as to be coupled with the second rotation shaft to be able to rearm the control mechanism, wherein the second wall of the housing comprises fixing means capable of fixing the rearming module and the rearming module includes a planetary gear system or a ratchet system.

2. The electrical switch according to claim 1, wherein when the rearming module includes the planetary gear system, the planetary gear system is driven by a crank or by an electric motor.

3. The electrical switch according to claim 1, wherein when the rearming module includes the ratchet system, the ratchet system is driven by a lever or by an electric motor.

4. The electrical switch according to claim 1, wherein the first rotation shaft comprises longitudinal splines, the first rotation sensor comprising complementary splines to be driven by the first rotation shaft.

5. The electrical switch according to claim 1, wherein the second rotation shaft comprises longitudinal splines, the rearming module comprising complementary splines to be driven by the second rotation shaft.

6. The electrical switch according to claim 1, characterized in that the rotation sensor is fixed against the first wall.

7. The electrical switch according to claim 1, wherein the first wall and the second wall are part of a same lateral wall of the housing of the control mechanism.

8. The electrical switch according to claim 1, characterized in that the first wall and the second wall correspond respectively to two opposite lateral walls of the housing of the control mechanism.

9. The electrical switch according to claim 1, wherein the switch comprises a second rotation sensor which is coupled with the second rotation shaft outside of the housing, so as to measure the angle of rotation of the second rotation shaft.

* * * * *